US009706327B2

(12) United States Patent
Brannmark et al.

(10) Patent No.: US 9,706,327 B2
(45) Date of Patent: Jul. 11, 2017

(54) AUDIO DECODER CONFIGURED TO CONVERT AUDIO INPUT CHANNELS FOR HEADPHONE LISTENING

(71) Applicant: DIRAC RESEARCH AB, Uppsala (SE)

(72) Inventors: Lars-Johan Brannmark, Uppsala (SE); Viktor Gunnarsson, Uppsala (SE)

(73) Assignee: DIRAC RESEARCH AB, Uppsala (SE)

( * ) Notice: Subject to any disclaimer, the term of this patent is extended or adjusted under 35 U.S.C. 154(b) by 0 days.

(21) Appl. No.: 14/787,977

(22) PCT Filed: Apr. 8, 2014

(86) PCT No.: PCT/SE2014/050434

§ 371 (c)(1),
(2) Date: Oct. 29, 2015

(87) PCT Pub. No.: WO2014/204377

PCT Pub. Date: Dec. 24, 2014

(65) Prior Publication Data

US 2016/0094929 A1 Mar. 31, 2016

Related U.S. Application Data

(60) Provisional application No. 61/818,522, filed on May 2, 2013.

(51) Int. Cl.

| | |
|---|---|
| ***H04R 5/02*** | (2006.01) |
| ***H04S 7/00*** | (2006.01) |
| ***H04S 1/00*** | (2006.01) |

(52) U.S. Cl.

CPC ..... *H04S 7/303* (2013.01); *H04R 5/02* (2013.01); *H04S 1/005* (2013.01); *H04S 1/007* (2013.01); *H04S 2420/01* (2013.01)

(58) Field of Classification Search

CPC ..... H04R 5/033; H04R 5/027; H04S 2420/01; H04S 1/005; H04S 2400/11; H04S 7/30; H04S 2400/01

(Continued)

(56) References Cited

U.S. PATENT DOCUMENTS

| | | | | |
|---|---|---|---|---|
| 2002/0039421 | A1 | 4/2002 | Kirkeby | |
| 2006/0205349 | A1 * | 9/2006 | Passier | H04R 27/00 455/41.2 |

(Continued)

FOREIGN PATENT DOCUMENTS

| | | | |
|---|---|---|---|
| WO | 98/20707 | A1 | 5/1998 |
| WO | 2006/033058 | A1 | 3/2006 |
| WO | 2009/102750 | A1 | 8/2009 |

OTHER PUBLICATIONS

International Search Report, dated Oct. 15, 2014, from corresponding PCT Application.

*Primary Examiner* — Alexander Jamal
(74) *Attorney, Agent, or Firm* — Young & Thompson

(57) ABSTRACT

The proposed technology provides an audio decoder (100) configured to receive input signals representative of at least two audio input channels. The audio decoder is configured to provide direct signal paths and cross-feed signal paths (10) for the input signals. The audio decoder is configured to apply head shadowing filters (20) in the direct signal paths and cross-feed signal paths for simulating head shadowing of loudspeakers placed at different angles to an intended listener. The audio decoder is also configured to apply phase shift filters (30) in the direct signal paths and cross-feed signal paths for introducing a phase difference between the direct signal paths and the cross-feed signal paths representing a phase difference occurring between the ears of the (Continued)

intended listener. The audio decoder is further configured to sum (40) the direct and cross-feed signal paths to provide output signals.

19 Claims, 12 Drawing Sheets

(58) Field of Classification Search
USPC ..... 381/309, 310
See application file for complete search history.

(56) References Cited

U.S. PATENT DOCUMENTS

2009/0182563 A1* 7/2009 Schobben ..... H04S 1/005 704/500
2011/0211702 A1* 9/2011 Mundt ..... H04S 3/004 381/17

* cited by examiner

AUDIO DECODER CONFIGURED TO CONVERT AUDIO INPUT CHANNELS FOR HEADPHONE LISTENING

TECHNICAL FIELD

The proposed technology generally relates to sound or audio reproduction, and more specifically to a method for decoding and a corresponding audio decoder, especially for use with earphones, a sound reproduction system comprising such an audio decoder and a computer program for decoding.

BACKGROUND

Music is normally produced and mixed for loudspeaker reproduction. When music is mixed for loudspeaker reproduction however, the resulting listening experience becomes less than optimal when listening through earphones.

The process of music production and music reproduction can together be said to consist of a sound encoding part and a sound decoding part. The encoding part entails music production and storage of the music material on a designated format, e.g. the CD format. The decoding part is the sound reproduction part which entails the whole procedure of reading the music signal from the storage format to the signal processing that enables presenting the music to the ears of the listeners. The decoding part normally entails sound reproduction by either loudspeaker or earphone listening.

A stereo music signal has information encoded in it that, when played back over loudspeakers in a listening room, results in psychoacoustic cues being presented to the listener that gives a certain spatial impression of the sound. By spatial impression is meant aspects of the sound that has to do with e.g. the location and size of each instrument in the sound image and what kind of acoustical space is perceptually associated with each instrument.

These spatial psychoacoustic cues become either strongly distorted or totally missing when earphones are used in the reproduction system.

An often used solution for making the perceived sound field more natural in earphones when reproducing a stereo signal is to use a cross-feed network to feed some of the left signal to the right ear, and some of the right signal to the left ear. See for example references [1], [2], and [3].

FIG. 1 is a schematic block diagram illustrating an example of a cross-feed network. The cross-feed filters as depicted in FIG. 1 are normally designed to give similar head-shadowing and Interaural Time Differences (ITD) as a normal stereo speaker setup in front of the listener would give. The goal is to control the sound stage width so that it becomes more natural.

In some implementations only the frequency dependent head shadowing is simulated and the ITD is kept at zero. The side-effect of this is that the sound stage loses ambience, and becomes too narrow. If a time-delay is inserted in the cross-feed signal paths $H_{RL}$ and $H_{LR}$ the sound stage proportions can be simulated properly but another problem arises—center panned sounds that are correlated between the left and right input channels experience a strong comb filtering effect in the addition of the direct-path and cross-feed path sound. This comb filtering effect colors the spectrum of the sound.

SUMMARY

The proposed technology overcomes these and other drawbacks of the prior art arrangements.

It is an object to provide a decoding method and a corresponding decoder, also referred to as an audio or sound decoder or a spatial decoder, or a binaural decoder.

It is also an object to provide a sound reproduction system comprising an audio decoder.

Yet another object is to provide a computer program for decoding, when executed by a processor, input signals representative of at least two audio input channels.

It is another object to provide a carrier comprising such a computer program.

These and other objects are met by embodiments of the proposed technology.

In a first aspect, the proposed technology provides an audio decoder configured to receive input signals representative of at least two audio input channels. The audio decoder is configured to provide direct signal paths and cross-feed signal paths for the input signals. The audio decoder is configured to apply head shadowing filters in the direct signal paths and cross-feed signal paths for simulating head shadowing of loudspeakers placed at different angles to an intended listener. The audio decoder is also configured to apply phase shift filters in the direct signal paths and cross-feed signal paths for introducing a phase difference between the direct signal paths and the cross-feed signal paths representing a phase difference occurring between the ears of the intended listener. The audio decoder is further configured to sum the direct and cross-feed signal paths to provide output signals.

In a second aspect, the proposed technology provides a method of decoding input signals representative of at least two audio input channels, where direct signal paths and cross-feed signal paths are provided for the input signals. The method comprises the step of applying head shadowing filters in the direct signal paths and cross-feed signal paths for simulating head shadowing of loudspeakers placed at different angles to an intended listener. The method also comprises the step of applying phase shift filters in the direct signal paths and cross-feed signal paths for introducing a phase difference between the direct signal paths on the one hand and the cross-feed signal paths on the other hand. The phase difference between the direct signal paths and the cross-feed signal paths represents the phase difference occurring between the ears of the intended listener when a signal is input on either of the input channels. The method further comprises the step of summing the direct and cross-feed signal paths to provide output signals.

In a third aspect, the proposed technology provides a sound reproduction system comprising an audio decoder according to the first aspect.

In a fourth aspect, the proposed technology provides a computer program for decoding, when executed by a processor, input signals representative of at least two audio input channels. The computer program comprises instructions, which when executed by the processor causes the processor to:

- provide a computer representation of direct signal paths and cross-feed signal paths for the input signals;
- apply head shadowing filters in the direct signal paths and cross-feed signal paths for simulating head shadowing of loudspeakers placed at different angles to an intended listener,
- apply phase shift filters in the direct signal paths and cross-feed signal paths for introducing a phase difference between the direct signal paths and the cross-feed signal paths representing a phase difference occurring between the ears of the intended listener; and sum the direct and cross-feed signal paths to provide output signals.

In a fifth aspect, the proposed technology provides a carrier comprising the computer program.

In a sixth aspect, the proposed technology provides an audio decoder configured to receive input signals representative of at least two audio input channels. The audio decoder comprises a representation module for providing a computer representation of direct signal paths and cross-feed signal paths for the input signals. The audio decoder also comprises a first filtering module for applying head shadowing filters in the direct signal paths and cross-feed signal paths for simulating head shadowing of loudspeakers placed at different angles to an intended listener. The audio decoder comprises a second filtering module for applying phase shift filters in the direct signal paths and cross-feed signal paths for introducing a phase difference between the direct signal paths and the cross-feed signal paths representing of a phase difference occurring between the ears of the intended listener. The audio decoder further comprises a summing module for summing the direct and cross-feed signal paths to provide output signals.

There is also provided a network client comprising an audio decoder as defined herein, and a network server comprising an audio decoder as defined herein.

For the particular application with earphones, the proposed technology provides a method of decoding the spatial cues present in a stereo signal (or in general a sound signal with more than one channel, i.e. L channels, where L>1) correctly for enabling earphone listening and adding missing spatial cues before the music signal is sent to the earphones.

In particular, the proposed technology aims at reproducing/simulating the perceived sound field proportions properly while not introducing a comb filtering effect.

Other advantages will be appreciated when reading the detailed description.

BRIEF DESCRIPTION OF THE DRAWINGS

The proposed technology, together with further objects and advantages thereof, may best be understood by making reference to the following description taken together with the accompanying drawings, in which.

DETAILED DESCRIPTION

Throughout the drawings, the same reference numbers are used for similar or corresponding elements.

Figure 2A:
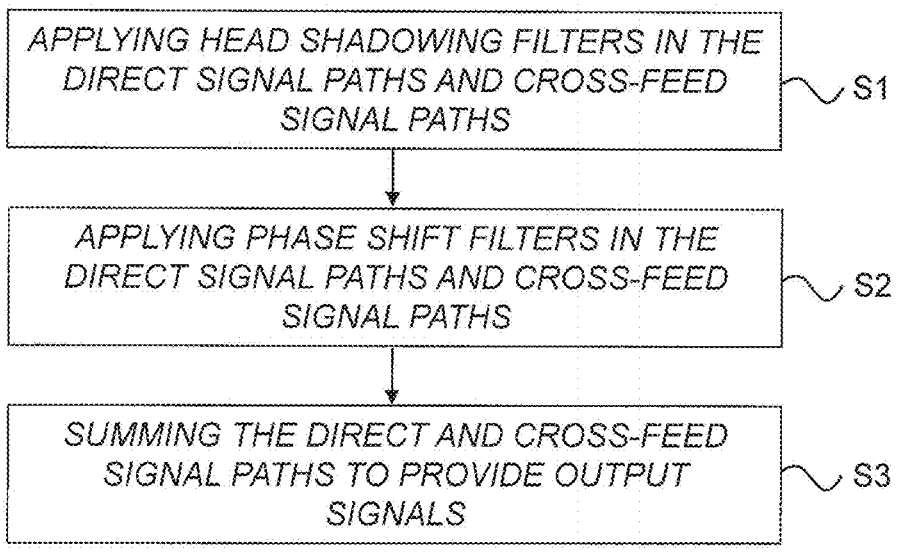
FIG. 2A is a schematic flow diagram illustrating an example of a method of decoding input signals representative of at least two audio input channels according to an embodiment.

FIG. 2A is a schematic flow diagram illustrating an example of a method of decoding input signals representative of at least two audio input channels according to an embodiment. Direct signal paths and cross-feed signal paths are provided for the input signals.

The method basically comprises the steps of:

applying, in step S1, head shadowing filters in the direct signal paths and cross-feed signal paths for simulating head shadowing of loudspeakers placed at different angles to an intended listener;

applying, in step S2, phase shift filters in the direct signal paths and cross-feed signal paths for introducing a phase difference between the direct signal paths on the one hand and the cross-feed signal paths on the other hand, said phase difference representing a phase difference occurring between the ears of the intended listener when a signal is input on either of the input channels; and summing, in step S3, the direct and cross-feed signal paths to provide output signals.

By way of example, the step S2 of applying phase shift filters in the direct signal paths and cross-feed signal paths is performed for introducing a frequency-dependent phase difference that mimics a phase difference occurring between the ears of the intended listener due to different arrival times of sound at the ears from the loudspeakers positioned with different angles to the head of the intended listener, so-called ITDs.

It should be understood that the order of the steps S1 and S2 may be interchanged if desired, provided the steps are designed to be time-invariant.

Figure 3:
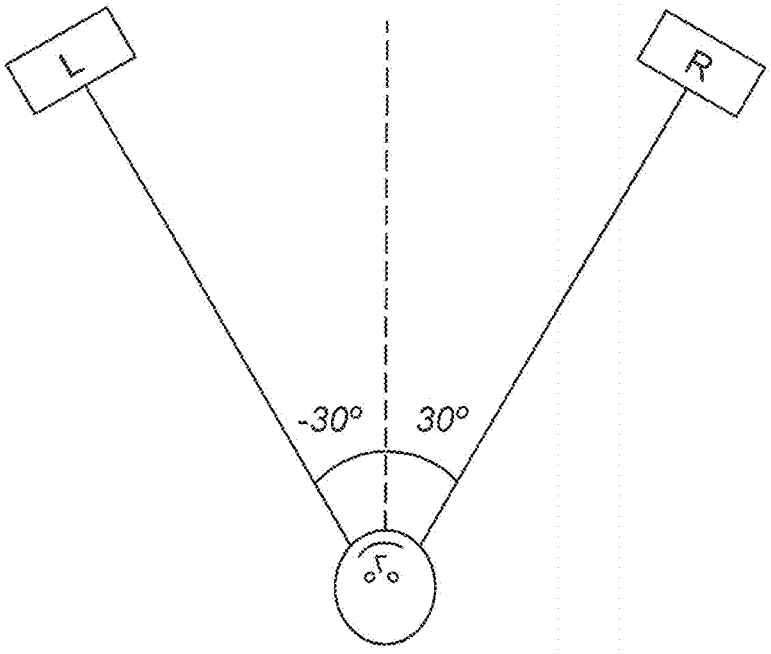
FIG. 3 is a schematic diagram illustrating an example of a loudspeaker setup with two loudspeakers symmetrically placed at different angles to a listener.

Reference can also be made to the schematic diagram of FIG. 3, which illustrates an example of a loudspeaker setup with two loudspeakers symmetrically placed at different angles to a listener.

Preferably, the frequency-dependent phase difference is introduced for frequencies below a threshold frequency. As an example, the threshold frequency is around 1 kHz.

Figure 2B:
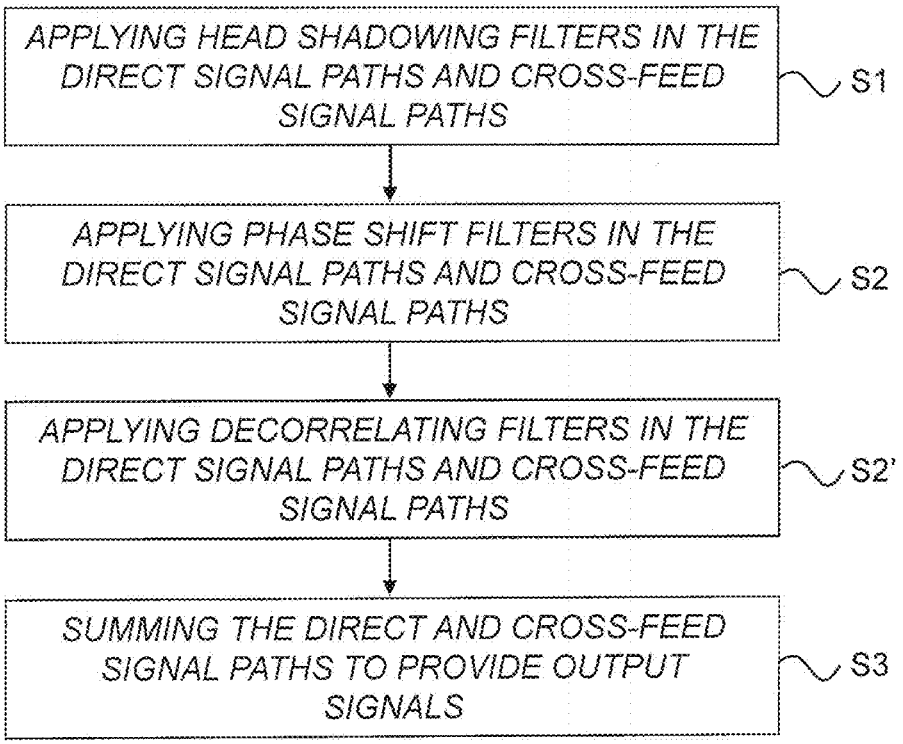
FIG. 2B is a schematic flow diagram illustrating an example of a method of decoding input signals representative of at least two audio input channels according to another embodiment.

FIG. 2B is a schematic flow diagram illustrating an example of a method of decoding input signals representative of at least two audio input channels according to another embodiment.

In this example, the method optionally further comprises the step S2' of applying, before the summing step S3, decorrelating filters in the direct signal paths and cross-feed signal paths for introducing or adjusting a phase difference between the direct signal paths and the cross-feed signal paths to be around 90 degrees above a threshold frequency. By way of example, the threshold frequency is around 1 kHz.

This allows for decorrelation of the signals in the summation where the direct signal paths and cross-feed signal paths are summed to produce one output signal.

It should be understood that the order of the steps S1, S2 and S2' may be interchanged if desired, provided the steps are designed to be time-invariant.

By way of example, the head shadowing filters may be based on Head Related Transfer Function, HRTF, responses with ITDs removed.

Preferably, the method is applied to pairs of channels in case of more than two input channels.

There is also provided a corresponding audio decoder configured to receive input signals representative of at least two audio input channels.

The audio decoder is configured to provide direct signal paths and cross-feed signal paths for the input signals.

The audio decoder is configured to apply head shadowing filters in the direct signal paths and cross-feed signal paths for simulating head shadowing of loudspeakers placed at different angles to an intended listener.

The audio decoder is also configured to apply phase shift filters in the direct signal paths and cross-feed signal paths for introducing a phase difference between the direct signal paths and the cross-feed signal paths representing a phase difference occurring between the ears of the intended listener.

The audio decoder is further configured to sum the direct and cross-feed signal paths to provide output signals.

Figure 4A:
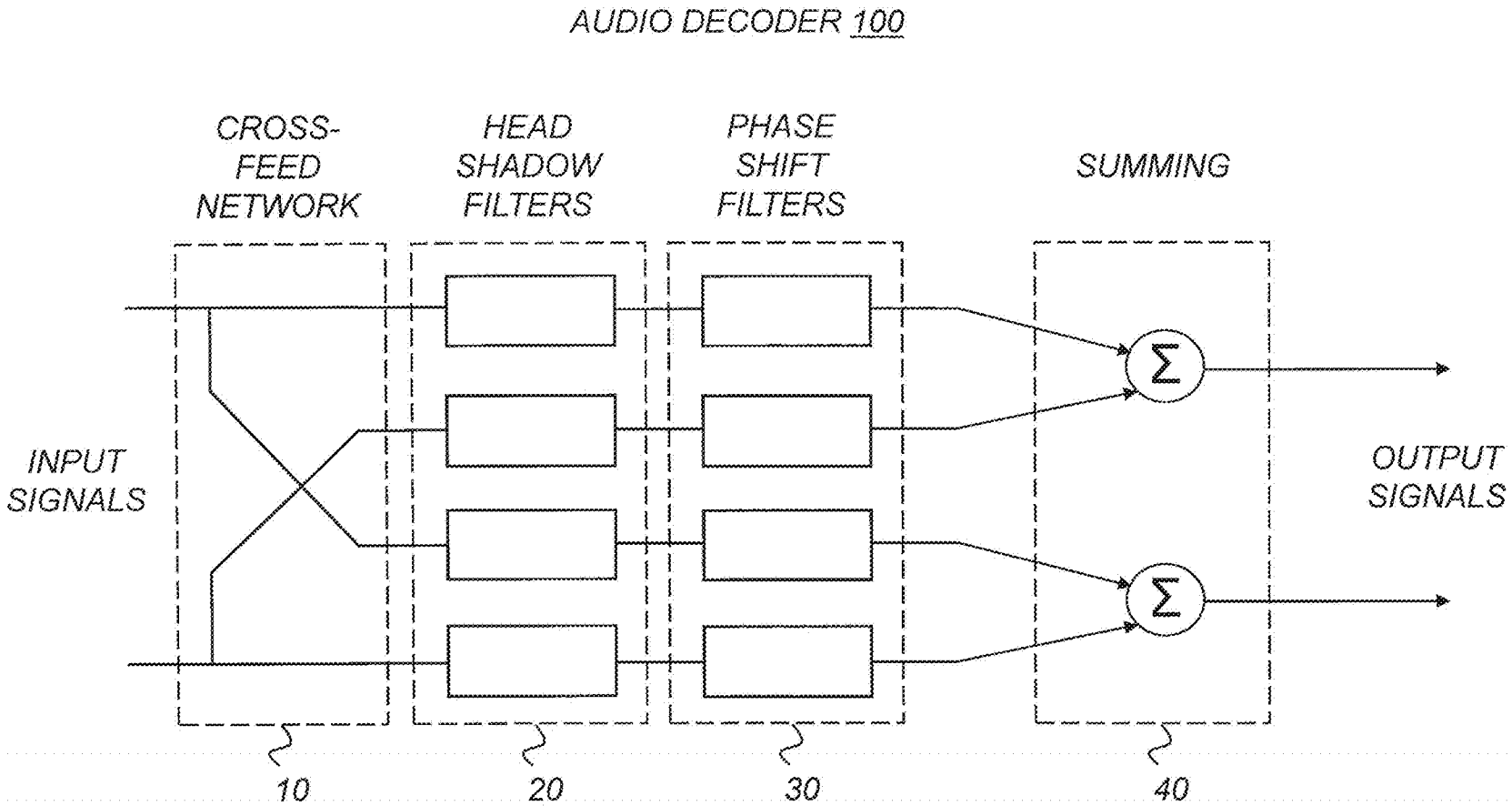
FIG. 4A is a schematic block diagram illustrating an example of an audio decoder according to an embodiment.

FIG. 4A is a schematic block diagram illustrating an example of an audio decoder according to an embodiment. The audio decoder 100 basically comprises a cross-feed network 10, head shadow filters 20, phase shift filters 30 and a summing block 40.

It should be understood that the order of the filter blocks 20 and 30 in FIG. 4A may be interchanged if desired, provided the filter blocks are designed to be time-invariant.

Figure 4B:
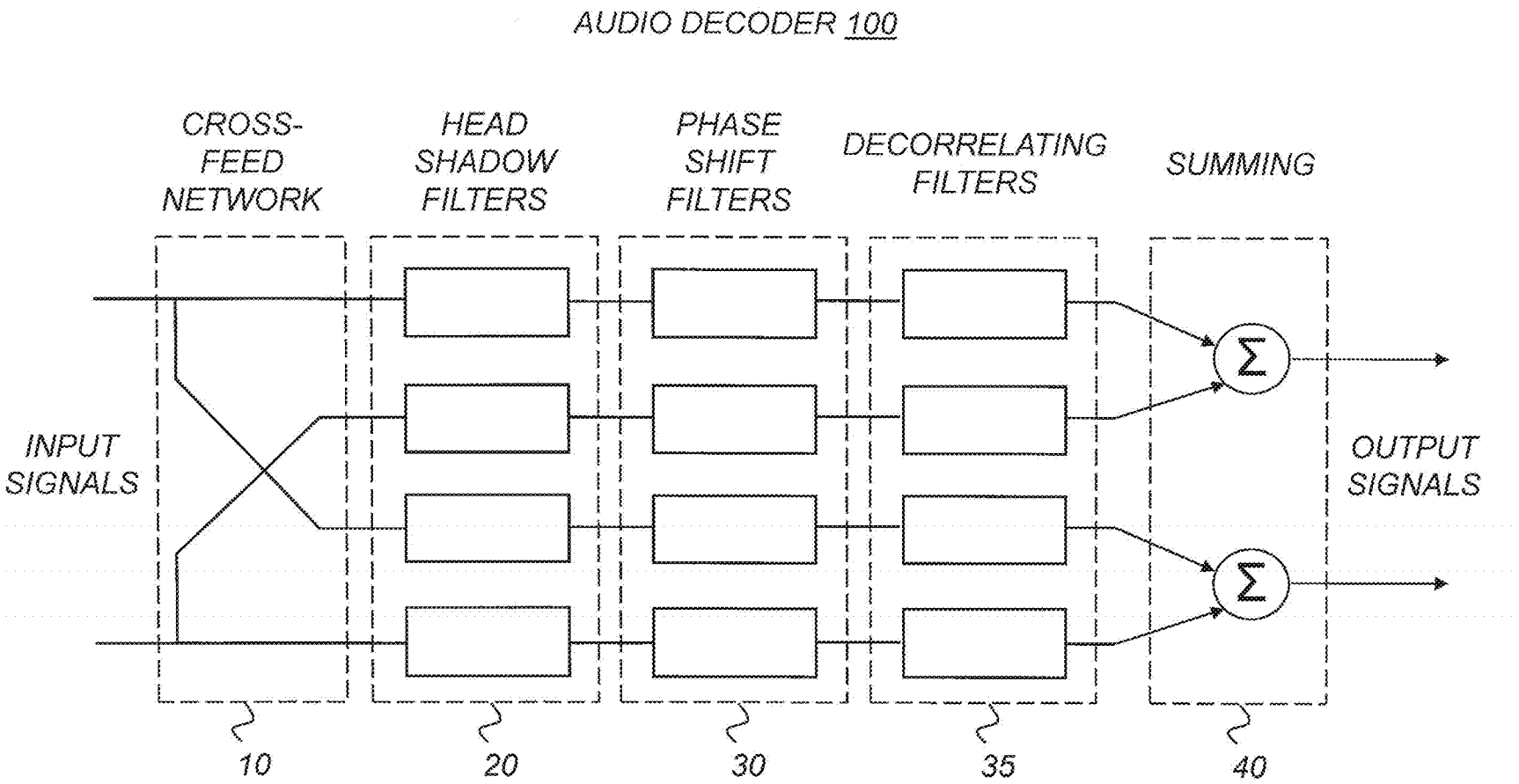
FIG. 4B is a schematic block diagram illustrating an example of an audio decoder according to another embodiment.

FIG. 4B is a schematic block diagram illustrating an example of an audio decoder according to another embodiment. In this example, the audio decoder 100 further comprises decorrelating filters 35, as will be explained later on.

It should be understood that the order of the filter blocks 20, 30 and 35 in FIG. 4B may be interchanged if desired, provided the filter blocks are designed to be time-invariant.

Figure 5:
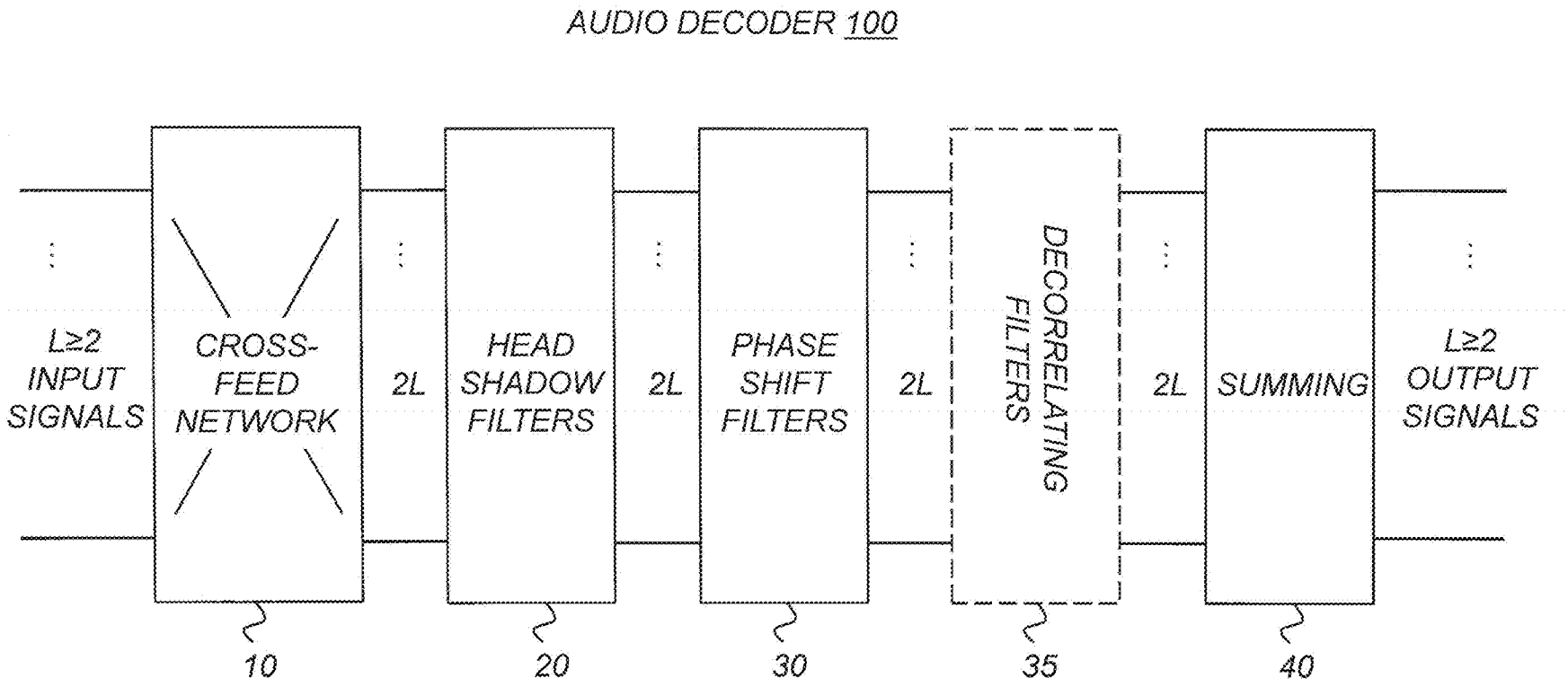
FIG. 5 is a schematic block diagram illustrating an example of an audio decoder according to a generalized embodiment.

FIG. 5 is a schematic block diagram illustrating an example of an audio decoder according to a generalized embodiment, with L input signals and L output signals, where L is an integer ≥2. The audio decoder 100 comprises a cross-feed network 10, a filter block 20 for head shadow filters, a filter block 30 for phase shift filters, an optional filter block 35 for decorrelating filters, and a summing block 40. After the cross-feed network 10, the number of signals is 2L and the number of signals is maintained until the summing block 40. In the summing block 40, the number of signals is once again reduced to L.

It should be understood that the order of the filter blocks 20, 30 and 35 in FIG. 5 may also be interchanged if desired, provided the filter blocks are designed to be time-invariant.

As exemplified in FIGS. 4A, 4B and 5, the audio decoder 100 comprises means 10 for providing direct signal paths and cross-feed signal paths for the input signals, and means 20 for applying head shadowing filters in the direct signal paths and cross-feed signal paths for simulating head shadowing of loudspeakers placed at different angles to an intended listener. The audio decoder 100 further comprises means 30 for applying phase shift filters in the direct signal paths and cross-feed signal paths for introducing a phase difference between the direct signal paths and the cross-feed signal paths representing a phase difference occurring between the ears of the intended listener, and means 40 for summing the direct and cross-feed signal paths to provide output signals.

Optionally, as indicated by the dashed lines in FIG. 5, the audio decoder 100 comprises means 35 for adjusting the phase difference between the direct signal paths and cross-feed signal paths, preferably in the form of decorrelating filters.

As an example, the audio decoder 100 may be configured to apply phase shift filters in the direct signal paths and cross-feed signal paths by introducing a frequency-dependent phase difference that mimics a phase difference occurring between the ears of the intended listener due to different arrival times of sound at the ears from the loudspeakers positioned with different angles to the head of the intended listener, so-called ITDs.

Preferably, the frequency-dependent phase difference is modeled for frequencies below a threshold frequency. By way of example, the threshold frequency is around 1 kHz.

In a particular example, as illustrated in FIG. 4B, the decoder 100 is further configured to apply decorrelating filters 35 in the direct signal paths and cross-feed signal paths for adjusting the phase difference between the direct signal paths and cross-feed signal paths to be constant around 90 degrees above a threshold frequency. By way of example, the threshold frequency is around 1 kHz.

As indicated above, the audio decoder 100 may be configured to provide the direct signal paths and cross-feed signal paths by means of a cross-feed network 10. In a particular example, the audio decoder 100 is further configured to apply head shadowing filters by means of an individual head shadowing filter arranged in each of the direct signal paths and cross-feed signal paths. The audio decoder 100 may also be configured to apply phase shift filters by means of a first all-pass filter arranged in each of the direct signal paths and a second different all-pass filter arranged in each of the cross-feed signal paths to provide a phase difference between the signals of the direct signal paths on the one hand and the signals of the cross-feed signal paths on the other hand.

For example, the head shadowing filters may be based on HRTF responses with ITDs removed. By way of example, the HRFTs may be obtained in any suitable way, e.g. based on HRTF modelling, accessed through public HRTF databases, and/or through HRTF measurements.

If there are more than two input channels, the audio decoder 100 is typically configured to apply to pairs of channels.

In a particular application, the output signals are intended to be sent to a set of earphones 130.

As indicated, a particular example of the audio decoder 100 is a stereo decoder. It should though be understood that the invention is not limited thereto.

Figure 6:
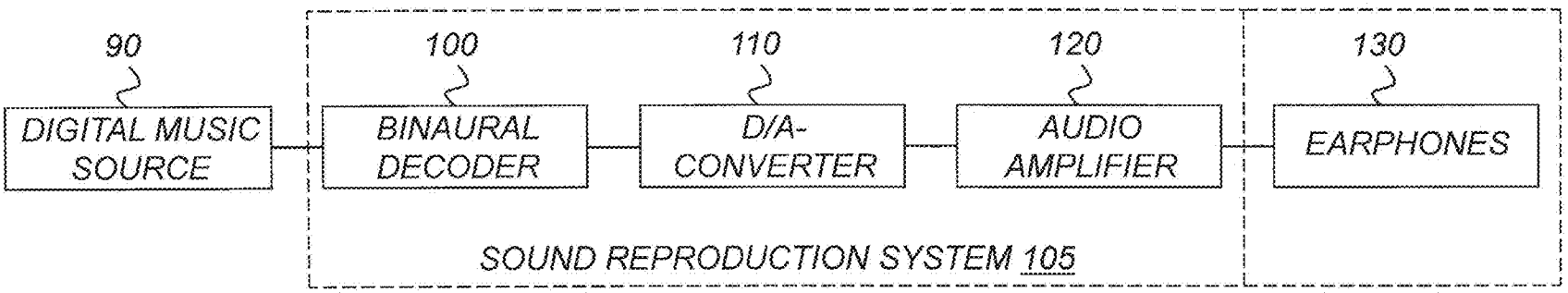
FIG. 6 is a schematic block diagram illustrating an example of how the binaural decoder would typically be used in a playback chain.

FIG. 6 is a schematic block diagram illustrating an example of how the binaural decoder would typically be used in a playback chain. In this example, the playback chain basically comprises a digital music source 90, a binaural decoder 100, a digital-to-analog (D/A) converter 110, an audio amplifier 120 and a set of earphones 130 or similar loudspeaker equipment. A sound reproduction system 105 may be defined by the decoder 100, the D/A-converter 110 and the audio amplifier 120, and optionally the earphones 130. Hence, the sound reproduction system 105 is part of the playback chain.

It should also be understood that the decoder may be implemented in a server-client scenario, on the client side and/or on the server side. Naturally, the audio decoder 100 may be implemented in a network client, which may be a wired and/or wireless device including any type of user equipment such as mobile phones, smart phones, personal computers, laptops, pads and so on. Alternatively, the audio decoder 100 may be implemented in a network server, which is then configured to decode the audio signals and send the decoded audio signals in compressed or uncompressed form to the client which in turn effectuates the play-back. The audio signals may be decoded by the network server and transferred to the client in real-time, e.g. as streaming media files. Alternatively, the decoded audio signals are stored by the network server as pre-processed audio files, which may subsequently be transferred to the client. The pre-processed audio files includes the decoded audio signals or suitable representations thereof.

In a particular example, the decoder has two input channels and two output channels. As indicated above, the decoder may however be configured for more than two channels, and more generally for L channels, where L>1. For example, the decoder may be configured (duplicated) to apply to pairs of channels if the audio source has more than two channels.

In the following, however, a stereo input signal is assumed for convenience.

Figure 7:
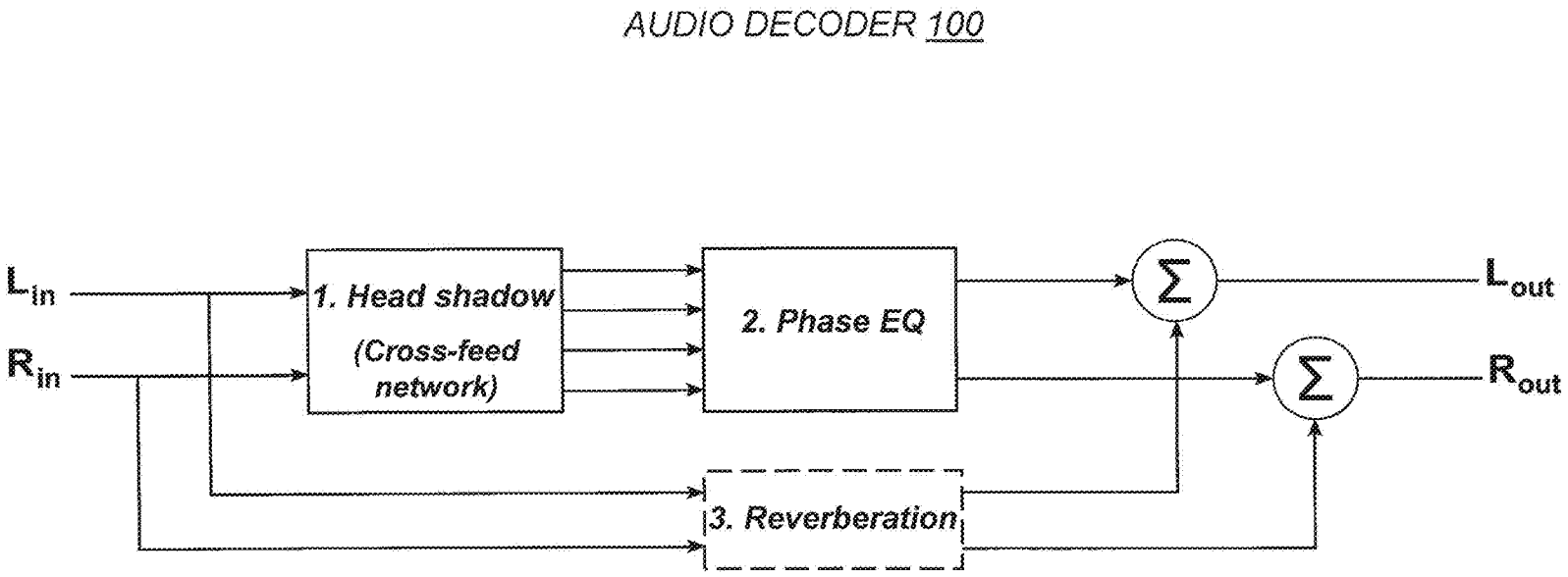
FIG. 7 is a schematic block diagram illustrating an overview of a particular example of a binaural decoder.

FIG. 7 is a schematic block diagram illustrating an overview of a non-limiting example of a binaural decoder. In this example, the decoder comprises a number of signal processing blocks. Each block is described in detail in the following section. $L_{in}$ and $R_{in}$ is the original left and right stereo signals and $L_{out}$ and $R_{out}$ are the processed left and right output signals of the system, intended to be sent to earphones.

Figure 1:
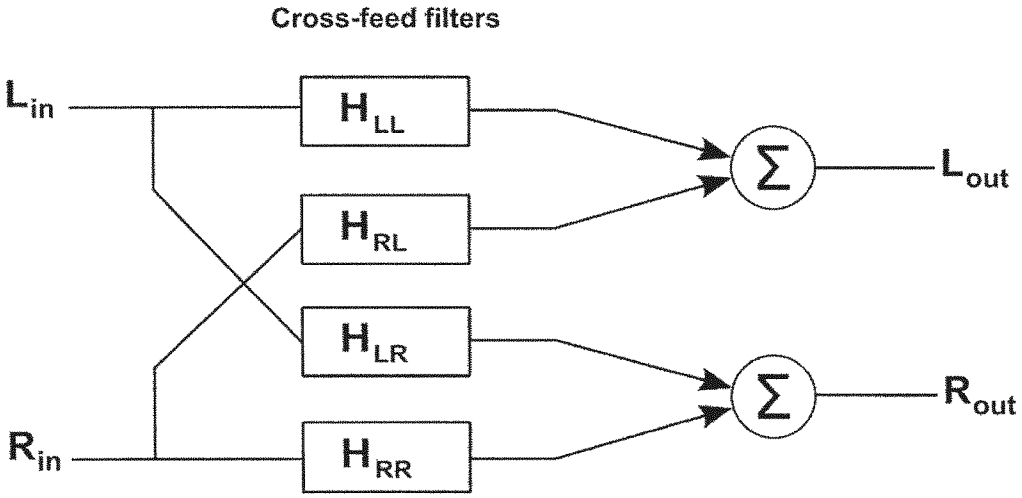
FIG. 1 is a schematic block diagram illustrating an example of a cross-feed network.

The head shadow block (1) splits up the signal into direct and cross-feed signals in the same way as depicted in FIG. 1, but without summing the signals. Head shadowing filters are applied, simulating the head shadowing (but typically not the ITD) of two loudspeakers placed at different angles to the listener. A typical example would be to simulate loudspeakers placed horizontally before the listener in the standard ±30 degrees symmetrical stereo setup, as schematically illustrated in FIG. 3.

The Phase Equalizer (EQ) block (2) applies phase shift filters to the direct and cross-feed signals, designed in such a way so that low-frequency ITD is simulated with the corresponding phase shift between the direct and cross-feed signals and there is no comb-filtering effect when the direct and cross-feed signals are summed inside the block. ITD is more important for localization at low frequencies than at high frequencies, so the ITD does not need to be simulated in the frequency range where it gives rise to annoying comb filtering effects.

The Reverberation block (3) is optional and adds reverberation ambience to the sound, which is always present when listening to loudspeakers in a real room.

Below, examples of the signal processing blocks depicted in FIG. 7 are described in more detail.

Example of Block 1—Head Shadow

An example of a head shadow block simulates head shadowing at the ears corresponding to sound incident from two loudspeakers placed at different angles to the listener. In this example, the filters used for head shadowing correspond to average HRTF responses for a number of listeners but with ITDs removed. Preferably, this is done by aligning the start of the impulse responses corresponding to the head shadowing filters applied in the direct and cross-feed signal paths, respectively. For more information on the concepts of HRTF, ITD and relevant psychoacoustics, see reference [5].

Figure 8:
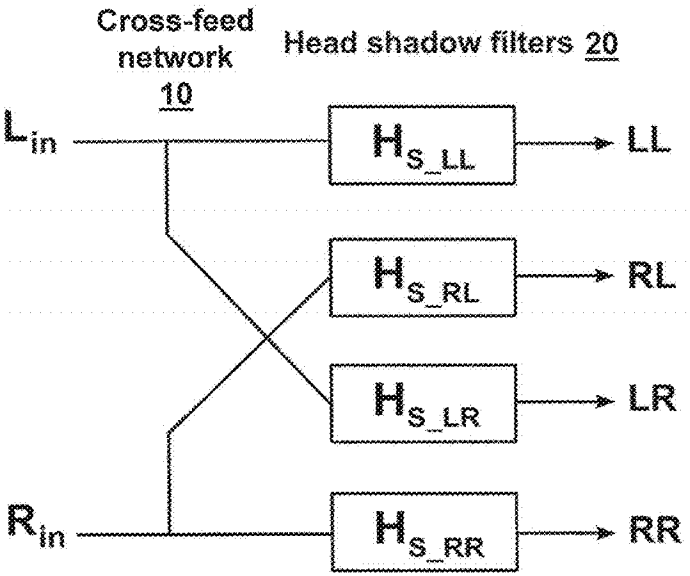
FIG. 8 is a schematic block diagram illustrating an example of a head shadow block.

As can be seen in FIG. 8, the output signals of the head shadowing block are composed of 1) direct signal paths from $L_{in}$ to $L_{out}$ and from $R_{in}$ to $R_{out}$ indicated by subscripts LL and RR in the signal processing blocks, and 2) cross-feed signal paths from $L_{in}$ to $R_{out}$ and from $R_{in}$ to $L_{out}$ indicated by subscripts LR and RL in the signal processing blocks.

For head shadowing, an important design variable is the amount of head shadow as a function of frequency, i.e. the frequency-dependent amplitude difference occurring between the ears of an intended listener when a signal is applied at one of the inputs.

Another important design variable is how the head shadow filters influence the perceived timbre of the sound. Under certain conditions, frequency response correction through equalization can be performed to adjust the perceived timbral characteristics of the sound.

Example of Block 2—Phase EQ

Figure 9:
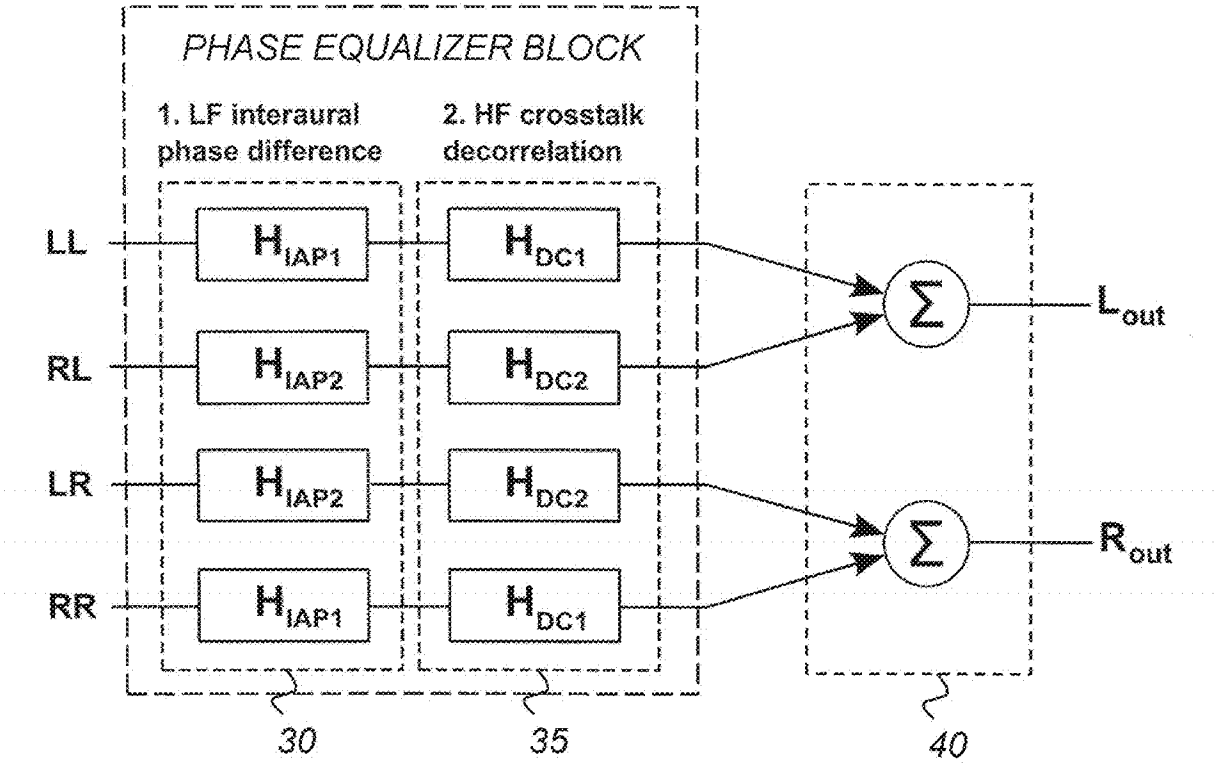
FIG. 9 is a schematic block diagram illustrating an example of a phase equalizer block.

An example of the design of the Phase EQ block is depicted in FIG. 9. The block is divided into two separate parts 30, 35. At least one of these parts is required—they may be used together or on their own. These parts are described below. In this example, each signal processing block inside the Phase EQ block (see also FIG. 7) has all-pass characteristics and the purpose of the Phase EQ block is to give certain desired properties in the summing or summation of the direct and cross-feed signal paths. The summing is shown in FIG. 9 to illustrate the relation to the Phase EQ block.

For general information on all-pass filters and basic signal processing, see reference [4].

Example of Phase EQ Part 1—LF Interaural Phase Difference

For example, the first part 30 of the Phase EQ block may introduce a phase shift between at least two signals, such as the left and right ear signals by applying a separate all-pass filter $H_{IAP1}$ to the direct path signals and a different all-pass filter $H_{IAP2}$ to the cross-feed signals. An important design parameter for $H_{IAP1}$ and $H_{IAP2}$ is for example the frequency dependency of the phase difference between $H_{IAP1}$ and $H_{IAP2}$. A phase difference is achieved by designing $H_{IAP1}$ and $H_{IAP2}$ with slightly different filter coefficients.

By way of example, the phase difference applied mimics the phase difference occurring between the ears naturally due to the different arrival times (ITD) of sound at the ears from a pair of loudspeakers positioned with different angles to the head. Thus, the perceived sound stage width becomes more natural compared to just simulating head shadowing. The ITD phase difference is modeled up to a maximum frequency of around 1 kHz. Above this frequency the phase difference between the $H_{IAP1}$ and $H_{IAP2}$ filters approaches zero to avoid comb filtering effects in the summation of the direct and cross-feed signal paths at the output.

Example of Phase EQ Part 2—HF Crosstalk Decorrelation

For example, the second part 35 of the Phase EQ block may implement decorrelating all-pass filters between the direct and cross-feed signal paths in a structure similar to part 1. The purpose of $H_{DC1}$ and $H_{DC2}$ is to make the phase difference between the direct and cross-feed signal paths become close to 90 degrees at high frequencies (above for example 1 kHz, the phase difference between $H_{DC1}$ and $H_{DC2}$ approaches zero at low frequencies). This is because if the phase difference is too small between the direct and cross-feed signal paths, the stereo difference signal (the signal produced by taking L-R) is strongly weakened in a way that does not happen at the ears of a listener in regular loudspeaker listening.

Example of Block 3—Reverberation

For example, the reverberation signal processing part is optional and applies reverberation filters to the signal. The reverb impulse response can for example be designed to be statistically similar to that found at the ears of a listener in a listening room with a perfectly diffuse sound field.

Implementation and Usage Examples

Different implementations and usages of the decoder are possible, for example:

1. The decoder may be implemented as a software algorithm on a mobile device for real-time decoding of sound.
2. The decoder may be implemented in hardware as an ASIC (Application Specific Integrated Circuit) or may be provided as a software library for integration in a DSP (Digital Signal Processor) or other kind of processing unit.
3. The decoder may be implemented in any kind of consumer electronics equipment designed for audio playback.
4. The decoder may be used for off-line decoding of audio that will be distributed to consumers via a media content provider.

In general, the proposed technology can be implemented in software, hardware, firmware or any combination thereof.

For example, the steps, functions, procedures and/or blocks described above may be implemented in hardware using any conventional technology, such as discrete circuit or integrated circuit technology, including both general-purpose electronic circuitry and application-specific circuitry.

Alternatively, at least some of the steps, functions, procedures and/or blocks described above may be implemented in software for execution by a suitable computer or processing device such as a microprocessor, Digital Signal Processor (DSP) and/or any suitable programmable logic device such as a Field Programmable Gate Array (FPGA) device, a Graphics Processing Unit (GPU) and a Programmable Logic Controller (PLC) device.

It should also be understood that it may be possible to re-use the general processing capabilities of any conventional unit. It may also be possible to re-use existing software, e.g. by reprogramming of the existing software or by adding new software components.

The flow diagram or diagrams presented herein may therefore be regarded as a computer flow diagram or diagrams, when performed by one or more processors. A corresponding apparatus may be defined as a group of function modules, where each step performed by the processor corresponds to a function module. In this case, the function modules are implemented as a computer program running on the processor.

Figure 10:
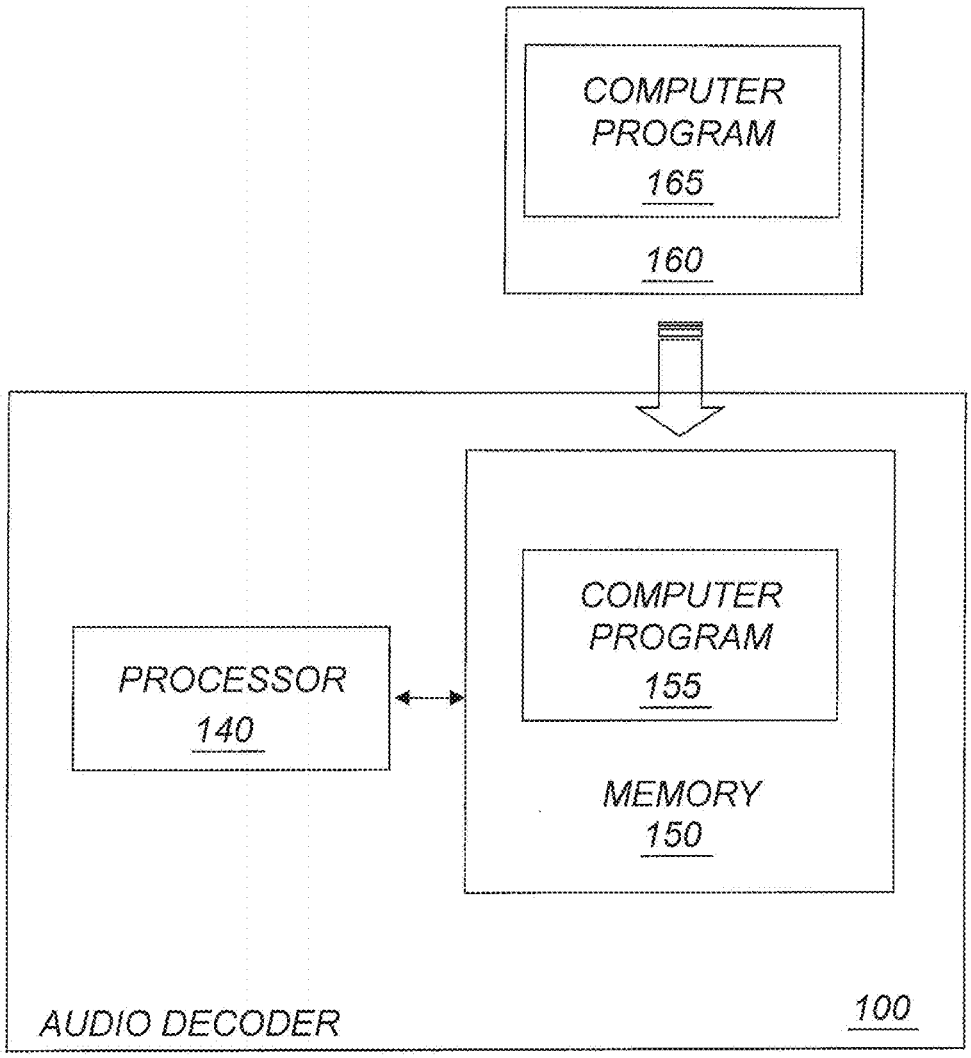
FIG. 10 is a schematic block diagram illustrating an example of an audio decoder based on a processor-memory implementation according to another embodiment.

In the following, an example of a computer implementation will be described with reference to FIG. 10, which illustrates an example of an audio decoder based on a processor-memory implementation. Here, the audio decoder 100 comprises one or more processors 140, and a memory 150. In this particular example, at least some of the steps, functions, procedures, modules and/or blocks described herein are implemented in a computer program 155/165, which is loaded into the memory 150 for execution by the processor(s) 140.

The processor(s) 140 and memory 150 are interconnected to each other to enable normal software execution. An optional input/output device may also be interconnected to the processor(s) 140 and/or the memory 150 to enable input and/or output of relevant data such as input parameter(s) and/or resulting output parameter(s).

In particular, the memory 150 comprises instructions executable by the processor 140, whereby the audio decoder 100 is operative to apply the head shadowing filters, to apply the phase shift filters and to sum the direct and cross-feed signal paths to provide output signals.

The term 'computer' should be interpreted in a general sense as any system or device capable of executing program code or computer program instructions to perform a particular processing, determining or computing task.

In a particular embodiment, the computer program 155/165 comprises instructions, which when executed by the processor 140 causes the processor 140 to:

provide a computer representation of direct signal paths and cross-feed signal paths for the input signals;

apply head shadowing filters in the direct signal paths and cross-feed signal paths for simulating head shadowing of loudspeakers placed at different angles to an intended listener, apply phase shift filters in the direct signal paths and cross-feed signal paths for introducing a phase difference between the direct signal paths and the cross-feed signal paths representing a phase difference occurring between the ears of the intended listener; and sum the direct and cross-feed signal paths to provide output signals.

The proposed technology also provides a carrier 150/160 comprising the computer program 155/165, wherein the carrier is one of an electronic signal, an optical signal, an electromagnetic signal, a magnetic signal, an electric signal, a radio signal, a microwave signal, or a computer-readable storage medium.

The software may be realized as a computer program product, which is normally carried on a computer-readable medium, for example a CD, DVD, USB memory, hard drive or any other conventional memory device. The software may thus be loaded into the operating memory of a computer/processor for execution by the processor of the computer. The computer/processor does not have to be dedicated to only execute the above-described steps, functions, procedure and/or blocks, but may also execute other software tasks.

As indicated herein, the audio decoder may alternatively be defined as a group of function modules, where the function modules are implemented as a computer program running on at least one processor.

The computer program residing in memory may thus be organized as appropriate function modules configured to perform, when executed by the processor, at least part of the steps and/or tasks described herein. An example of such function modules is illustrated in FIG. 11.

Figure 11:
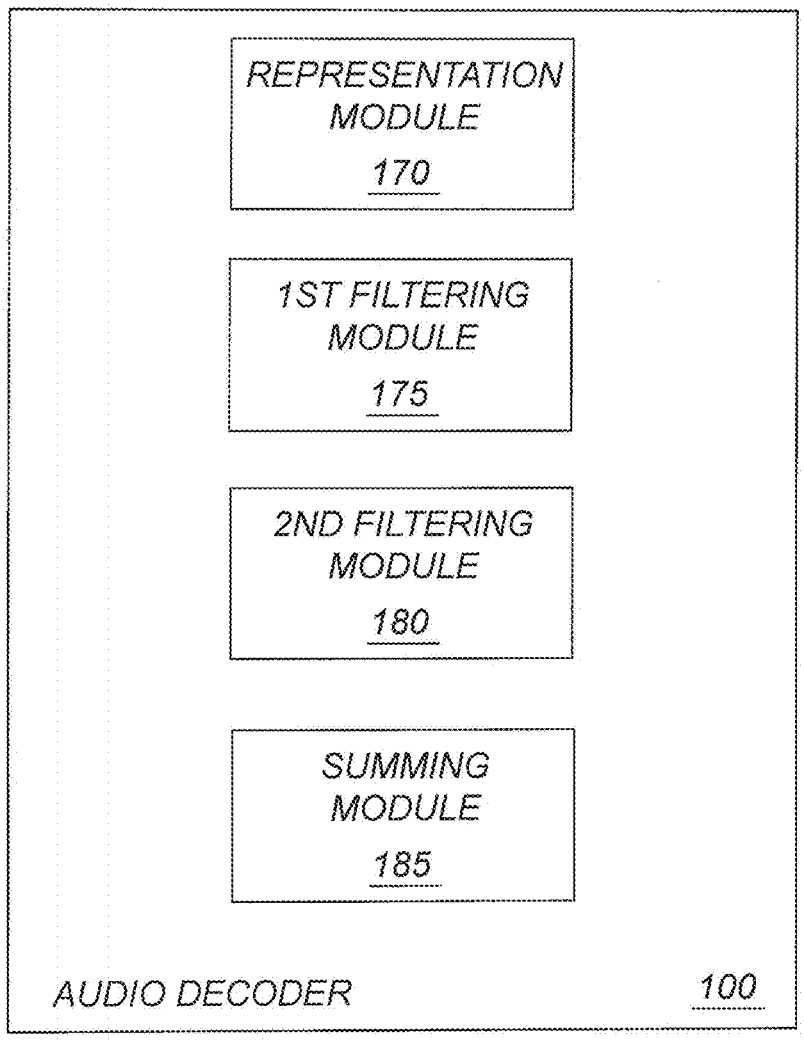
FIG. 11 is a schematic block diagram illustrating an example of an audio decoder based on function modules according to yet another embodiment.

FIG. 11 is a schematic block diagram illustrating an example of an audio decoder 100 comprising a group of function modules. In this example, the audio decoder 100 is configured to receive input signals representative of at least two audio input channels. The audio decoder 100 comprises a representation module 170, a first filtering module 175, a second filtering module 180, and a summing module 185.

The representation module 170 is adapted for providing a computer representation of direct signal paths and cross-feed signal paths for the input signals. The first filtering module 175 is adapted for applying head shadowing filters in the direct signal paths and cross-feed signal paths for simulating head shadowing of loudspeakers placed at different angles to an intended listener. The second filtering module 180 is adapted for applying phase shift filters in the direct signal paths and cross-feed signal paths for introducing a phase difference between the direct signal paths and the cross-feed signal paths representing a phase difference occurring between the ears of the intended listener. The summing module 185 is adapted for summing the direct and cross-feed signal paths to provide output signals.

In a particular example, the audio decoder 100 further comprises a third optional filtering module for applying decorrelating filters in the direct signal paths and cross-feed signal paths for adjusting the phase difference between the direct signal paths and cross-feed signal paths to be constant around 90 degrees above a threshold frequency.

The embodiments described above are merely given as examples, and it should be understood that the proposed technology is not limited thereto. It will be understood by those skilled in the art that various modifications, combinations and changes may be made to the embodiments without departing from the scope of the present invention. In particular, different part solutions in the different embodiments can be combined in other configurations, where technically possible.

REFERENCES

[1] Bauer, Benjamin B., "Stereophonic Earphones and Binaural Loudspeakers", Journal of the Audio Engineering Society, Volume 9 Issue 2 pp. 148-151; April 1961.

[2] Thomas, Martin V., "Improving the Stereo Headphone Sound Image", Journal of the Audio Engineering Society, Volume 25 Issue 7/8 pp. 474-478; August 1977.

[3] Linkwitz, Siegfried, "Improved Headphone Listening", Audio, North American Publishing Company, pp. 42-43; December 1971.

[4] Proakis, John. G. and Manolakis, Dimitris K., "Digital Signal Processing", Prentice Hall, 4 edition, 2006.

[5] Blauert, Jens, "Spatial hearing: the psychophysics of human sound localization", MIT Press, October, 1996.

The invention claimed is:

1. An audio decoder configured to receive input signals representative of at least two audio input channels, wherein said audio decoder is configured to provide direct signal paths and cross-feed signal paths for the input signals, wherein said audio decoder is configured to apply head shadowing filters in the direct signal paths and cross-feed signal paths for simulating head shadowing of loudspeakers placed at different angles to an intended listener, wherein said audio decoder is configured to apply phase shift filters in the direct signal paths and cross-feed signal paths for introducing a frequency-dependent phase difference between the direct signal paths and the cross-feed signal paths that mimics a phase difference occurring between the ears of the intended listener due to different arrival times of sound at the ears from said loudspeakers positioned with different angles to the head of the intended listener, that are Interaural Time Differences (ITD), the phase shift filters being configured such that a low-frequency ITD, below a threshold frequency, is simulated with the corresponding phase shift between the direct and cross-feed signals, said audio decoder is further configured to apply decorrelating filters in the direct signal paths and cross-feed signal paths for adjusting, above the threshold frequency, the phase difference between the direct signal paths and cross-feed signal paths to be constant around 90 degrees, and wherein said audio decoder is configured to sum the direct and cross-feed signal paths to provide output signals.

2. The audio decoder of claim 1, wherein said audio decoder comprises a processor and a memory, said memory comprising instructions executable by the processor, whereby the audio decoder is operative to apply the head shadowing filters, to apply the phase shift filters, and to sum the direct and cross-feed signal paths to provide output signals.

3. The audio decoder of claim 1, wherein said audio decoder comprises:

means for providing direct signal paths and cross-feed signal paths for the input signals;

means for applying head shadowing filters in the direct signal paths and cross-feed signal paths for simulating head shadowing of loudspeakers placed at different angles to an intended listener;

means for applying phase shift filters in the direct signal paths and cross-feed signal paths for introducing a phase difference between the direct signal paths and the cross-feed signal paths representing a phase difference occurring between the ears of the intended listener; and means for summing the direct and cross-feed signal paths to provide output signals.

4. The audio decoder of claim 1, wherein the threshold frequency is around 1 kHz.

5. The audio decoder of claim 1, wherein said audio decoder is configured to provide the direct signal paths and cross-feed signal paths by a cross-feed network, wherein said audio decoder is configured to apply head shadowing filters by an individual head shadowing filter arranged in each of the direct signal paths and cross-feed signal paths, and wherein said audio decoder is configured to apply phase shift filters by a first all-pass filter arranged in each of the direct signal paths and a second different all-pass filter arranged in each of the cross-feed signal paths to provide a phase difference between the signals of the direct signal paths on the one hand and the signals of the cross-feed signal paths on the other hand.

6. The audio decoder of claim 1, wherein the head shadowing filters are based on Head Related Transfer Function (HRTF) responses with interaural time differences (ITD) removed.

7. The audio decoder of claim 1, wherein the audio decoder is configured to apply to pairs of channels when there are more than two input channels.

8. The audio decoder of claim 1, wherein the output signals are intended to be sent to earphones.

9. The audio decoder of claim 1, wherein said audio decoder is a stereo decoder.

10. A method of decoding input signals representative of at least two audio input channels, in which direct signal paths and cross-feed signal paths are provided for the input signals, said method comprising:

applying head shadowing filters in the direct signal paths and cross-feed signal paths for simulating head shadowing of loudspeakers placed at different angles to an intended listener;

applying phase shift filters in the direct signal paths and cross-feed signal paths for introducing a frequency-dependent phase difference between the direct signal paths on the one hand and the cross-feed signal paths on the other hand, that mimics a phase difference occurring between the ears of the intended listener due to different arrival times of sound at the ears from said loudspeakers positioned with different angles to the head of the intended listener when a signal is input on either of the input channels, that are Interaural Time Differences (ITD), the phase shift filters being configured such that a low-frequency ITD, below a threshold frequency, is simulated with the corresponding phase shift between the direct and cross-feed signals;

applying decorrelating filters in the direct signal paths and cross-feed signal paths for introducing or adjusting, above the threshold frequency, a phase difference between the direct signal paths and the cross-feed signal paths to be around 90 degrees; and summing the direct and cross-feed signal paths to provide output signals.

11. The method of claim 10, wherein the threshold frequency is around 1 kHz.

12. The method of claim 10, wherein the head shadowing filters are based on Head Related Transfer Function (HRTF) responses with interaural time differences (ITD) removed.

13. The method of claim 10, wherein the method is applied to pairs of channels in case of more than two input channels.

14. A sound reproduction system comprising:

the audio decoder of claim 1.

15. The sound reproduction system of claim 14, wherein said sound reproduction system is part of a playback chain.

16. A non-transitory computer-program product comprising a computer-readable storage medium for decoding, when executed by a processor, input signals representative of at least two audio input channels, said computer program comprising instructions, which when executed by the processor causes the processor to:

provide a computer representation of direct signal paths and cross-feed signal paths for the input signals;

apply head shadowing filters in the direct signal paths and cross-feed signal paths for simulating head shadowing of loudspeakers placed at different angles to an intended listener;

apply phase shift filters in the direct signal paths and cross-feed signal paths for introducing a frequency-dependent phase difference between the direct signal paths and the cross-feed signal paths that mimics a phase difference occurring between the ears of the intended listener due to different arrival times of sound at the ears from said loudspeakers positioned with different angles to the head of the intended listener, that are Interaural Time Differences (ITD), the phase shift filters being configured such that a low-frequency ITD, below a threshold frequency, is simulated with the corresponding phase shift between the direct and cross-feed signals;

apply decorrelating filters in the direct signal paths and cross-feed signal paths for introducing or adjusting, above the threshold frequency, a phase difference between the direct signal paths and the cross-feed signal paths to be around 90 degrees; and sum the direct and cross-feed signal paths to provide output signals.

17. An audio decoder (100) configured to receive input signals representative of at least two audio input channels, said audio decoder comprising:

a representation module for providing a computer representation of direct signal paths and cross-feed signal paths for the input signals;

a first filtering module for applying head shadowing filters in the direct signal paths and cross-feed signal paths for simulating head shadowing of loudspeakers placed at different angles to an intended listener;

a second filtering module for applying phase shift filters in the direct signal paths and cross-feed signal paths for introducing a frequency-dependent phase difference between the direct signal paths and the cross-feed signal paths that mimics a phase difference occurring between the ears of the intended listener due to different arrival times of sound at the ears from said loudspeakers positioned with different angles to the head of the intended listener, that are Interaural Time Differences (ITD), the phase shift filters being configured such that a low-frequency ITD, below a threshold frequency, is simulated with the corresponding phase shift between the direct and cross-feed signals;

a third filtering module for applying decorrelating filters in the direct signal paths and cross-feed signal paths for adjusting, above the threshold frequency, the phase difference between the direct signal paths and cross-feed signal paths to be constant around 90 degrees; and a summing module for summing the direct and cross-feed signal paths to provide output signals.

18. A network client comprising:

the audio decoder of claim 1.

19. A network server comprising:

the audio decoder of claim 1.

* * * * *